US007493767B2

(12) United States Patent
Bunker et al.

(10) Patent No.: US 7,493,767 B2
(45) **Date of Patent: *Feb. 24, 2009**

(54) METHOD AND APPARATUS FOR COOLING COMBUSTOR LINER AND TRANSITION PIECE OF A GAS TURBINE

(75) Inventors: Ronald Scott Bunker, Niskayuna, NY (US); Jeremy Clyde Bailey, Middle Grove, NY (US); Stanley Kevin Widener, Greeneville, SC (US); Thomas Edward Johnson, Greer, SC (US); John C Intile, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 679 days.

This patent is subject to a terminal disclaimer.

(21) Appl. No.: 10/907,866

(22) Filed: Apr. 19, 2005

(65) Prior Publication Data

US 2005/0268615 A1 Dec. 8, 2005

Related U.S. Application Data

(63) Continuation-in-part of application No. 10/709,886, filed on Jun. 3, 2004, now Pat. No. 7,010,921.

(51) Int. Cl.
*F02C 1/00* (2006.01)
*F02G 3/00* (2006.01)

(52) U.S. Cl. ..... 60/752; 60/759

(58) Field of Classification Search ..... 60/752–760, 60/804, 39.37

See application file for complete search history.

(56) References Cited

U.S. PATENT DOCUMENTS

| | | | | | |
|---|---|---|---|---|---|
| 4,719,748 | A | | 1/1988 | Davis, Jr. et al. | 60/39.37 |
| 5,024,058 | A | * | 6/1991 | Shekleton et al. | 60/752 |
| 5,226,278 | A | * | 7/1993 | Meylan et al. | 60/755 |
| 5,353,865 | A | * | 10/1994 | Adiutori et al. | 165/133 |
| 5,758,504 | A | * | 6/1998 | Abreu et al. | 60/754 |
| 5,784,876 | A | * | 7/1998 | Alkabie | 60/776 |
| 5,802,841 | A | * | 9/1998 | Maeda | 60/784 |
| 6,098,397 | A | | 8/2000 | Glezer et al. | 60/39.02 |
| 6,134,877 | A | * | 10/2000 | Alkabie | 60/800 |

(Continued)

*Primary Examiner*—William H Rodriguez
(74) *Attorney, Agent, or Firm*—Cantor Colburn LLP

(57) ABSTRACT

A method and apparatus for cooling a combustor liner and transitions piece of a gas turbine include a combustor liner with a plurality of turbulators arranged in an array axially along a length defining a length of the combustor liner and located on an outer surface thereof; a first flow sleeve surrounding the combustor liner with a first flow annulus therebetween, the first flow sleeve having a plurality of rows of cooling holes formed about a circumference of the first flow sleeve for directing cooling air from the compressor discharge into the first flow annulus; a transition piece connected to the combustor liner and adapted to carry hot combustion gases to a stage of the turbine; a second flow sleeve surrounding the transition piece a second plurality of rows of cooling apertures for directing cooling air into a second flow annulus between the second flow sleeve and the transition piece; wherein the first plurality of cooling holes and second plurality of cooling apertures are each configured with an effective area to distribute less than 50% of compressor discharge air to the first flow sleeve and mix with cooling air from the second flow annulus.

20 Claims, 12 Drawing Sheets

U.S. PATENT DOCUMENTS

| | | | | |
|---|---|---|---|---|
| 6,314,716 | B1 * | 11/2001 | Abreu et al. | 60/773 |
| 6,484,505 | B1 | 11/2002 | Brown et al. | 60/760 |
| 6,494,044 | B1 * | 12/2002 | Bland | 60/772 |
| 6,526,756 | B2 * | 3/2003 | Johnson et al. | 60/772 |
| 6,530,225 | B1 * | 3/2003 | Hadder | 60/772 |
| 6,681,578 | B1 * | 1/2004 | Bunker | 60/772 |
| 6,684,620 | B2 * | 2/2004 | Tiemann | 60/39.37 |
| 6,761,031 | B2 * | 7/2004 | Bunker | 60/752 |
| 7,010,921 | B2 * | 3/2006 | Intile et al. | 60/752 |
| 7,043,921 | B2 * | 5/2006 | Hadder | 60/772 |
| 7,082,766 | B1 * | 8/2006 | Widener et al. | 60/752 |
| 7,104,067 | B2 * | 9/2006 | Bunker | 60/752 |
| 7,310,938 | B2 * | 12/2007 | Marcum et al. | 60/39.37 |
| 2006/0042255 | A1 * | 3/2006 | Bunker et al. | 60/752 |

* cited by examiner

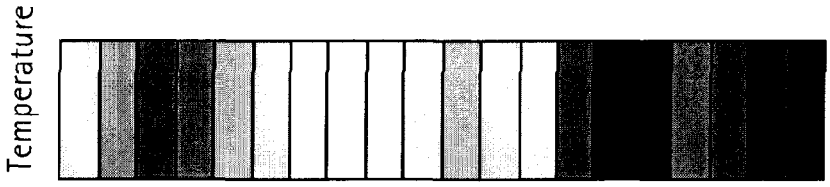
FIG. 10
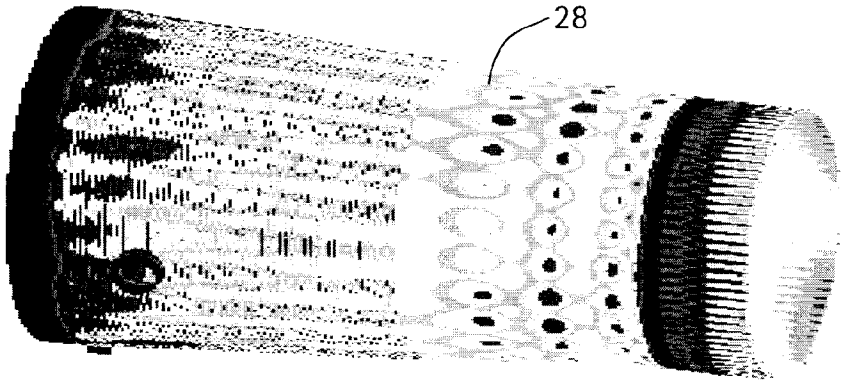
FIG. 11
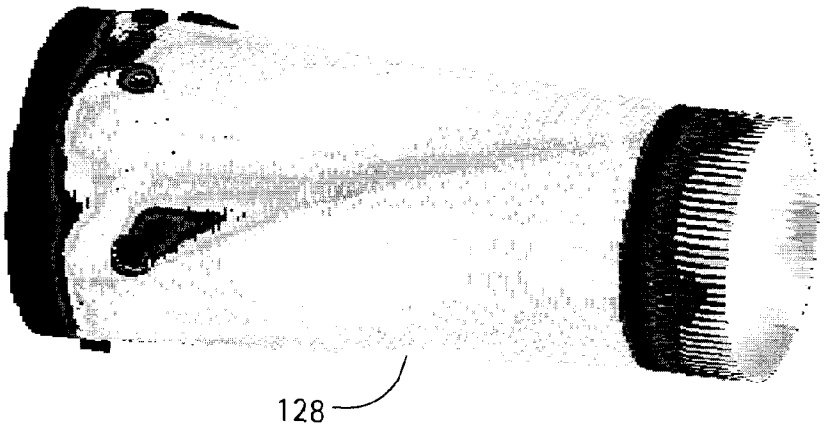

In-Line Impingement Array
Heat Transfer Coefficient Improvements
Relative to Smooth Surface Non-Impinging Convection

METHOD AND APPARATUS FOR COOLING COMBUSTOR LINER AND TRANSITION PIECE OF A GAS TURBINE

CROSS REFERENCE TO RELATED APPLICATIONS

This is a continuation-in-part of application Ser. No. 10/709,886 U.S. Pat. No. 7,010,921 filed on Jun. 03, 2004, which is herein incorporated by reference.

BACKGROUND OF THE INVENTION

This invention relates to internal cooling within a gas turbine engine; and more particularly, to apparatus and method for providing better and more uniform cooling of the liner and transition piece of the gas turbine engine combustor.

Traditional gas turbine combustors use diffusion (i.e., non-premixed) combustion in which fuel and air enter the combustion chamber separately. The process of mixing and burning produces flame temperatures exceeding 3900° F. Since conventional combustors and/or transition pieces having liners are generally capable of withstanding a maximum temperature on the order of only about 1500° F. for about ten thousand hours (10,000 hrs.), steps to protect the combustor and/or transition piece must be taken. This has typically been done by film-cooling which involves introducing relatively cool compressor air into a plenum formed by the combustor liner surrounding the outside of the combustor. In this prior arrangement, the air from the plenum passes through louvers in the combustor liner and then passes as a film over the inner surface of the liner, thereby maintaining combustor liner temperatures at an acceptable level.

Because diatomic nitrogen rapidly disassociates at temperatures exceeding about 3000° F. (about 1650° C.) and reacts readily with oxygen at such temperatures, the high temperatures of diffusion combustion result in relatively high NOx emissions. One approach to reducing NOx emissions has been to premix the maximum possible amount of compressor air with fuel. The resulting lean premixed combustion produces cooler flame temperatures and thus lower NOx emissions. Although lean premixed combustion is cooler than diffusion combustion, the flame temperature is still too hot for prior conventional combustor components to withstand without some form of active cooling.

Furthermore, because the advanced combustors premix the maximum possible amount of air with the fuel for NOx reduction, little or no cooling air is available, making film-cooling of the combustor liner and transition piece impractical. Nevertheless, combustor liners require active cooling to maintain material temperatures below limits. In dry low NOx (DLN) emission systems, this cooling can only be supplied as cold side convection. Such cooling must be performed within the requirements of thermal gradients and pressure loss. Thus, means such as thermal barrier coatings in conjunction with "backside" cooling have been considered to protect the combustor liner and transition piece from destruction by such high heat. Backside cooling involves passing the compressor discharge air over the outer surface of the transition piece and combustor liner prior to premixing the air with the fuel.

With respect to the combustor liner, one current practice is to impingement cool the liner, or to provide linear turbulators on the exterior surface of the liner. Another more recent practice is to provide an array of concavities on the exterior or outside surface of the liner (see U.S. Pat. No. 6,098,397). The various known techniques enhance heat transfer but with varying effects on thermal gradients and pressure losses. Turbulation strips work by providing a blunt body in the flow, which disrupts the flow creating shear layers and high turbulence to enhance heat transfer on the surface. Dimple concavities function by providing organized vortices that enhance flow mixing and scrub the surface to improve heat transfer.

A low heat transfer rate from the liner can lead to high liner surface temperatures and ultimately loss of strength. Several potential failure modes due to the high temperature of the liner include, but are not limited to, low cycle fatigue cracking and bulging. These mechanisms shorten the life of the liner, requiring replacement of the part prematurely.

Accordingly, there remains a need for enhanced levels of active cooling with minimal pressure losses at higher firing temperatures than previously available while extending a combustion inspection interval to decrease the cost to produce electricity.

BRIEF DESCRIPTION OF THE INVENTION

The above discussed and other drawbacks and deficiencies are overcome or alleviated in an exemplary embodiment by an apparatus for cooling a combustor liner and transitions piece of gas turbine. The apparatus includes a combustor liner with a plurality of turbulators arranged in an array axially along a length defining a length of the combustor liner and located on an outer surface thereof; a first flow sleeve surrounding the combustor liner with a first flow annulus therebetween, the first flow sleeve having a plurality of rows of cooling holes formed about a circumference of the first flow sleeve for directing cooling air from the compressor discharge into the first flow annulus; a transition piece connected to the combustor liner and adapted to carry hot combustion gases to a stage of the turbine; a second flow sleeve surrounding the transition piece a second plurality of rows of cooling apertures for directing cooling air into a second flow annulus between the second flow sleeve and the transition piece; wherein the first plurality of cooling holes and second plurality of cooling apertures are each configured with an effective area to distribute less than 50% of compressor discharge air to the first flow sleeve and mix with cooling air from the second flow annulus.

In yet another embodiment, a turbine engine includes a combustion section; a compressor air discharge section upstream of the combustion section; a transition region between the combustion and air discharge section; a turbulated combustor liner defining a portion of the combustion section and transition region, the turbulated combustor liner including a plurality of turbulators arranged in an array axially along a length defining a length of the combustor liner and located on an outer surface thereof; a first flow sleeve surrounding the combustor liner with a first flow annulus therebetween, the first flow sleeve having a plurality of rows of cooling holes formed about a circumference of the first flow sleeve for directing cooling air from compressor discharge air into the first flow annulus; a transition piece connected to at least one of the combustor liner and the first flow sleeve, the transition piece adapted to carry hot combustion gases to a stage of the turbine corresponding to the combustor air discharge section; a second flow sleeve surrounding the transition piece, the second flow sleeve having a second plurality of rows of cooling apertures for directing cooling air into a second flow annulus between the second flow sleeve and the transition piece, the first flow annulus connecting to the second flow annulus; wherein the first plurality of cooling holes and second plurality of cooling apertures are each configured with an effective area to distribute less than 50% of compressor discharge air to the first flow sleeve and mix with cooling air from the second flow annulus.

In an alternative embodiment, a method for cooling a combustor liner of a gas turbine combustor is disclosed. The combustor liner includes a substantially circular cross-section, and a first flow sleeve surrounding the liner in substantially concentric relationship therewith creating a first flow annulus therebetween for feeding air from compressor discharge air to the gas turbine combustor, and wherein a transition piece is connected to the combustor liner, with the transition piece surrounded by a second flow sleeve, thereby creating a second flow annulus in communication with the first flow annulus. The method includes providing a plurality of axially spaced rows of cooling holes in the flow sleeves, each row extending circumferentially around the flow sleeves, a first of the rows in the second sleeve is located proximate an end where the first flow sleeve interfaces; supplying cooling air from compressor discharge to the cooling holes; and configuring the cooling holes with an effective area to distribute less than a third of combustion air to the first flow sleeve and mix with a remaining compressor discharge air flowing from said second flow annulus. In an exemplary embodiment, the cooling holes are configured with an effective area to distribute between about 25% and about 40% of compressor discharge air to said first flow sleeve and mix with cooling air from said second flow annulus.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures:

FIG. 10 is a perspective view of a conventional flow sleeve illustrating relative differences in predicted metal temperatures during backside cooling and along a length thereof;

FIG. 11 is a perspective view of a flow sleeve illustrating relative differences in predicted metal temperatures during backside cooling and along a length thereof in accordance with an exemplary embodiment;

DETAILED DESCRIPTION OF THE INVENTION

Figure 1:
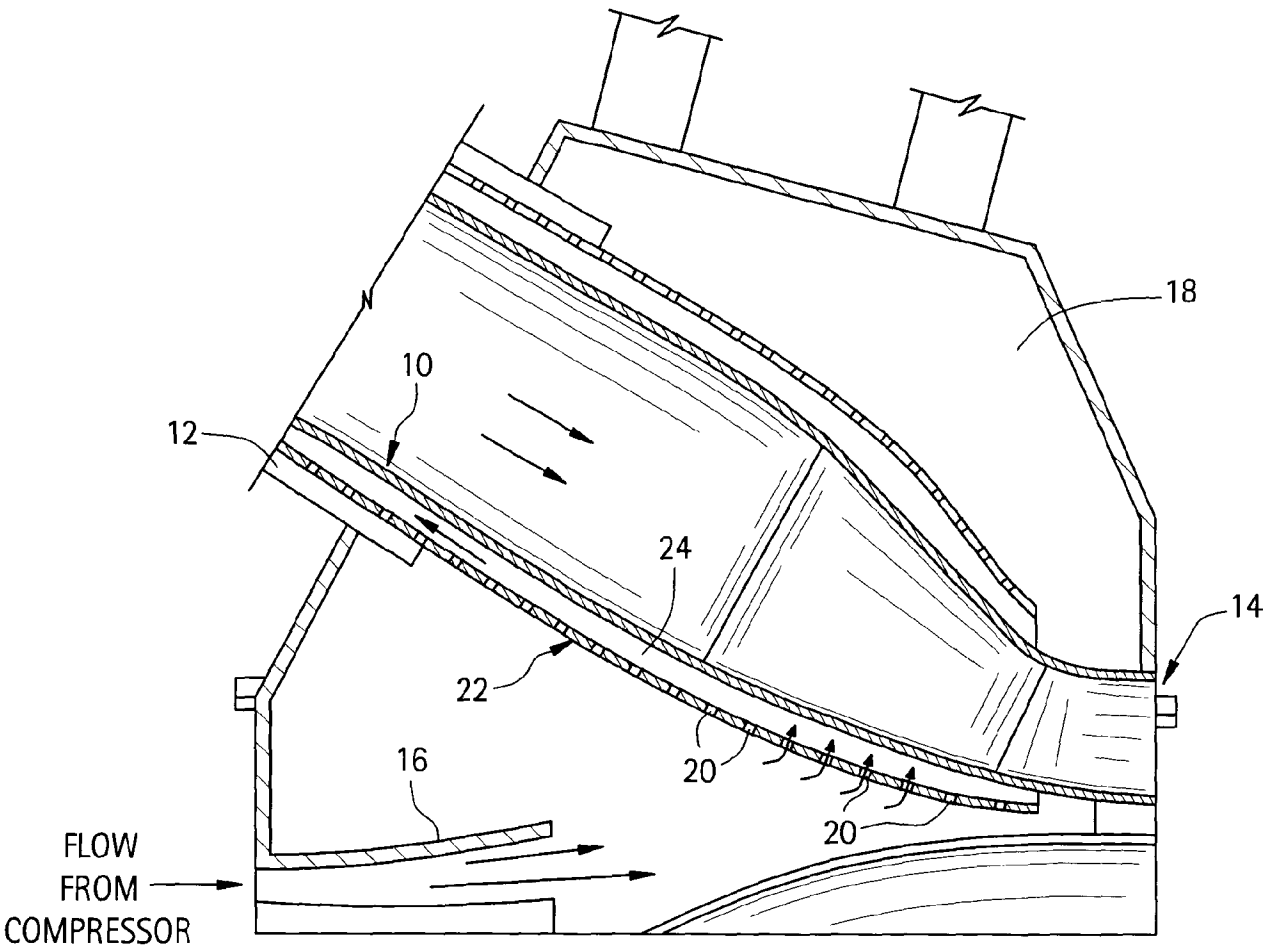
FIG. 1 PRIOR ART
FIG. 1 is a simplified side cross section of a conventional combustor transition piece aft of the combustor liner.
Figure 2:
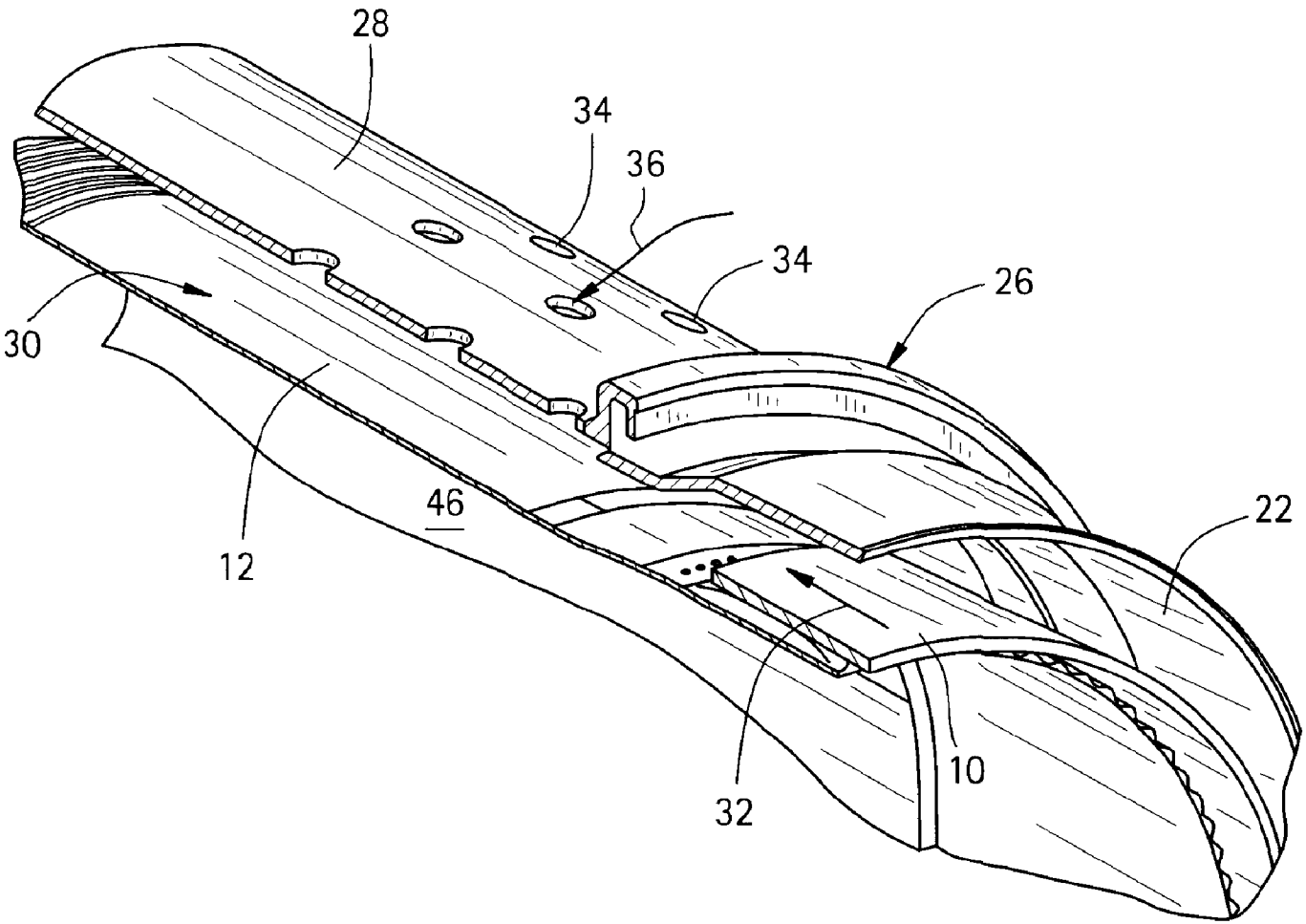
FIG. 2 is a partial but more detailed perspective of a conventional combustor liner and flow sleeve joined to the transition piece.

With reference to FIGS. 1 and 2, a typical gas turbine includes a transition piece 10 by which the hot combustion gases from an upstream combustor as represented by the combustor liner 12 are passed to the first stage of a turbine represented at 14. Flow from the gas turbine compressor exits an axial diffuser 16 and enters into a compressor discharge case 18. A portion of the compressor discharge air is diverted to cool the turbine, and the remainder passes to the combustor as combustion air. About 50% of the combustion air passes through apertures 20 formed along and about a transition piece impingement sleeve 22 for flow in an annular region or annulus 24 (or, second flow annulus) between the transition piece 10 and the radially outer transition piece impingement sleeve 22. The remaining approximately 50% (excepting the air that goes to the turbine nozzle and shroud for cooling) of the combustion air flow passes into flow sleeve holes or cooling holes 34 of an upstream combustion liner cooling sleeve (not shown) and into an annulus between the cooling sleeve and the liner and eventually mixes with the air in annulus 24. This combined air eventually mixes with the gas turbine fuel in a combustion chamber. It should be noted in the disclosed embodiments herein that there is also compressor discharge air going to the turbine inlet nozzle, so it should not be implied that the "remaining" air includes this nozzle cooling air. It will be recognized by those skilled in the pertinent art that the 50% and/or the "less than a third" value refers to the combustor air, and the compressor discharge air includes an additional proportion of air that is used for turbine cooling.

FIG. 2 illustrates the connection between the transition piece 10 and the combustor flow sleeve 28, as it would appear at the far left hand side of FIG. 1. Specifically, the impingement sleeve 22 (or, second flow sleeve) of the transition piece 10 is received in a telescoping relationship in a mounting flange 26 on the aft end of the combustor flow sleeve 28 (or, first flow sleeve), and the transition piece 10 also receives the combustor liner 12 in a telescoping relationship. It is contemplated that combustor liner 12 is either a cast alloy liner or a wrought alloy liner. The combustor flow sleeve 28 surrounds the combustor liner 12 creating a flow annulus 30 (or, first flow annulus) therebetween. It can be seen from the flow arrow 32 in FIG. 2, that crossflow cooling air traveling in the annulus 24 continues to flow into the annulus 30 in a direction perpendicular to impingement cooling air flowing through the cooling holes 34 (see flow arrow 36) formed about the circumference of the flow sleeve 28 (while three rows are shown in FIG. 2, the flow sleeve may have any number of rows of such holes).

In an exemplary embodiment described in greater detail below, the cooling holes 34 are implemented as impingement jets or non penetrating fluid jets. When the cooling holes 34 are employed as impingement or non penetrating fluid jets, the cooling holes may be disposed in either a staggered or an in-line manner about the circumference of the flow sleeve 28. In this context, staggered means that each successive row of holes is rotated by one-half hole pitch spacing from a previous row; conversely, in-line means that each successive row is in a same circumferential orientation. The in-line manner is preferred. Within the spirit of this invention, other hole orientations may be implemented. Additionally, the cooling holes 34, may be configured or dimensioned to provide mass velocity ratios near unity.

Still referring to FIGS. 1 and 2, a typical can annular reverse-flow combustor is shown for a turbine that is driven by the combustion gases from a fuel where a flowing medium with a high energy content, i.e., the combustion gases, produces a rotary motion as a result of being deflected by rings of blading mounted on a rotor. In operation, discharge air from the compressor (compressed to a pressure on the order of about 250-400 lb/in 2) reverses direction as it passes over the outside of the combustor liners (one shown at 12) and again as it enters the combustor liner 12 en route to the turbine (first stage indicated at 14). Compressed air and fuel are burned in the combustion chamber, producing gases with a temperature of between about 1500° C. and about 2800° F. These combustion gases flow at a high velocity into turbine section 14 via transition piece 10.

Hot gases from the combustion section in combustion liner 12 flow therefrom into section 16. There is a transition region indicated generally at 46 in FIG. 2 between these two sections. As previously noted, the hot gas temperature at the aft end of section 12, the inlet portion of region 46, is on the order of about 2800° F. However, the liner metal temperature at the downstream, outlet portion of region 46 is preferably on the order of 1400°-1550° F. To help cool the liner to this lower metal temperature range, during passage of heated gases through region 46, flow sleeve 28 is provided through which cooling air is flowed. The cooling air serves to draw off heat from the liner and thereby significantly lower the liner metal temperature relative to that of the hot gases.

Figure 3:
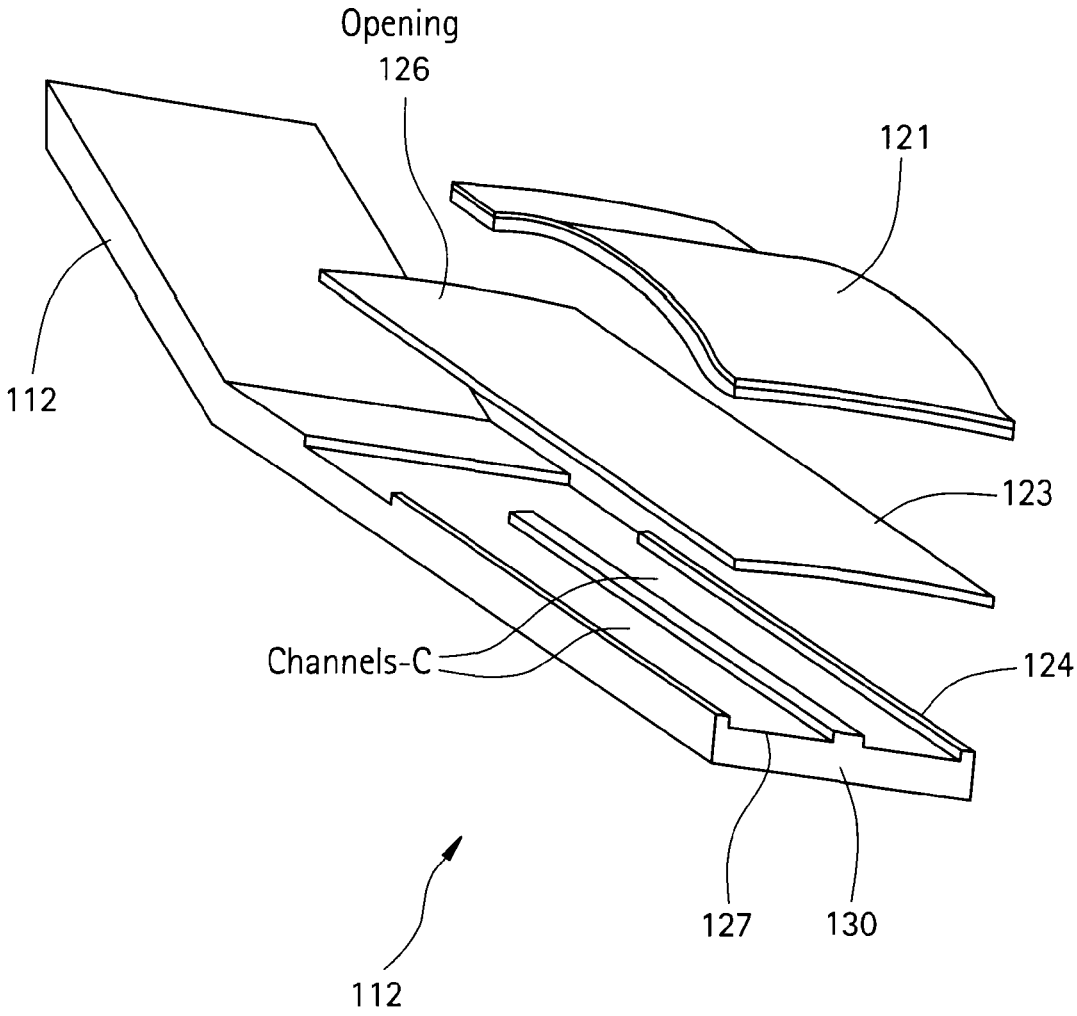
FIG. 3 is an exploded partial view of a liner aft end in accordance with an exemplary embodiment.

In an exemplary embodiment referring to FIG. 3, liner 112 has an associated compression-type seal 121, commonly referred to as a hula seal, mounted between a cover plate 123 of the liner 112, and a portion of transition region 46. The cover plate is mounted on the liner to form a mounting surface for the compression seal and to form a portion of the axial airflow channels C. As shown in FIG. 3, liner 112 has a plurality of axial channels formed with a plurality of axial raised sections or ribs 124 all of which extend over a portion of aft end of the liner 112. The cover plate 123 and ribs 124 together define the respective airflow channels C. These channels are parallel channels extending over a portion of aft end of liner 112. Cooling air is introduced into the channels through air inlet slots or openings 126 at the forward end of the channel. The air then flows into and through the channels C and exits the liner through openings 127 at an aft end 130 of the liner.

In accordance with the disclosure, the design of liner 112 is such as to minimize cooling air flow requirements, while still providing for sufficient heat transfer at aft end 130 of the liner, so to produce a uniform metal temperature along the liner. It will be understood by those skilled in the art that the combustion occurring within section 12 of the turbine results in a hot-side heat transfer coefficient and gas temperatures on an inner surface of liner 112. Outer surface (aft end) cooling of current design liners is now required so metal temperatures and thermal stresses to which the aft end of the liner is subjected remain within acceptable limits. Otherwise, damage to the liner resulting from excessive stress, temperature, or both, significantly shortens the useful life of the liner.

Liner 112 of the present invention utilizes existing static pressure gradients occurring between the coolant outer side, and hot gas inner side, of the liner to effect cooling at the aft end of the liner. This is achieved by balancing the airflow velocity in liner channels C with the temperature of the air so to produce a constant cooling effect along the length of the channels and the liner.

Figure 4:
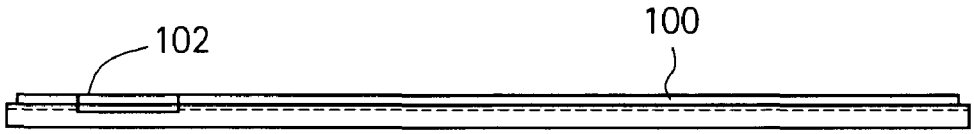
FIG. 4 PRIOR ART
FIG. 4 is an elevation view of a prior art aft liner region and an aft liner region of the present invention for flowing cooling air through a plurality of channels in a transition region between the combustor liner and the combustor transition piece.

As shown in FIG. 4, a prior art liner, indicated generally at 100, has a flow metering hole 102 extending across the forward end of the cover plate 123. As indicated by the dotted lines extending the length of liner 100, the cross-section of the channel, as defined by its height, is constant along the entire length of the channel. This channel height is, for example, 0.045" (0.11 cm).

Figure 5:
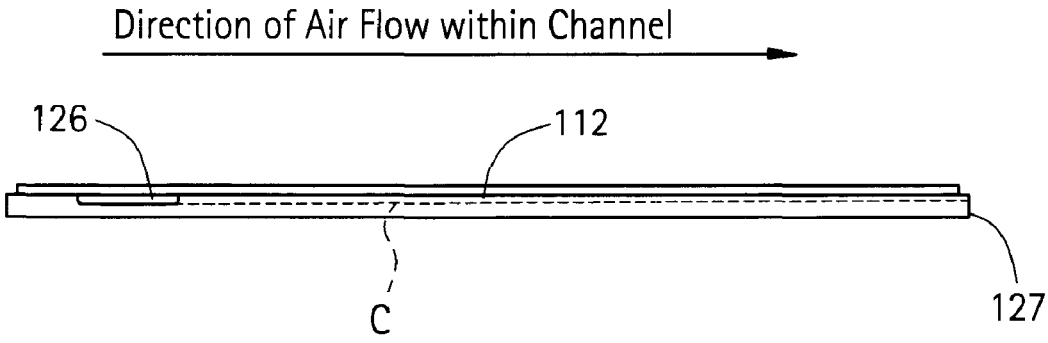
FIG. 5 is an elevation view of an aft liner region of the present invention for flowing cooling air through a plurality of channels in a transition region between the combustor liner and the combustor transition piece.

In contrast referring to FIG. 5, liner 112 of the present invention has a channel height which is substantially (approximately 45%) greater than the channel height of liner 100 at inlet 126 to the channel. However, this height steadily and uniformly decreases along the length of channel C so that, at the aft end of the channel, the channel height is substantially (approximately 55%) less than exit height of prior art liner 100. Liner 112 has, for example, an entrance channel height of 0.065" (0.16 cm) and an exit height of, for example, 0.025" (0.06 cm), so the height of the channel decreases by slightly more than 60% from the inlet end to the outlet end of the channel.

In comparing prior art liner 100 with liner 112 of the present invention, it has been found that reducing the height of the channels (not shown) in liner 100, in order to match the cooling flow of liner 112, will not provide sufficient cooling to produce acceptable metal temperatures in liner 100, nor does it effectively change; i.e., minimize, the flow requirement for cooling air through the liner. Rather, it has been found that providing a variable cooling passage height within liner 112 optimizes the cooling at aft end 130 of the liner. With a variable channel height, optimal cooling is achieved because the local air velocity in the channel is now balanced with the local temperature of the cooling air flowing through the channel. That is, because the channel height is gradually reduced along the length of each channel, the cross-sectional area of the channel is similarly reduced. This results in an increase in the velocity of the cooling air flowing through channels C and can produce a more constant cooling heat flux along the entire length of each channel. Liner 112 therefore has the advantage of producing a more uniform axial thermal gradient, and reduced thermal stresses within the liner. This, in turn, results in an increased useful service life for the liner. As importantly, the requirement for cooling air to flow through the liner is now substantially reduced, and this air can be routed to combustion stage of the turbine to improve combustion and reduce exhaust emissions, particularly NOx emissions.

Figure 6:
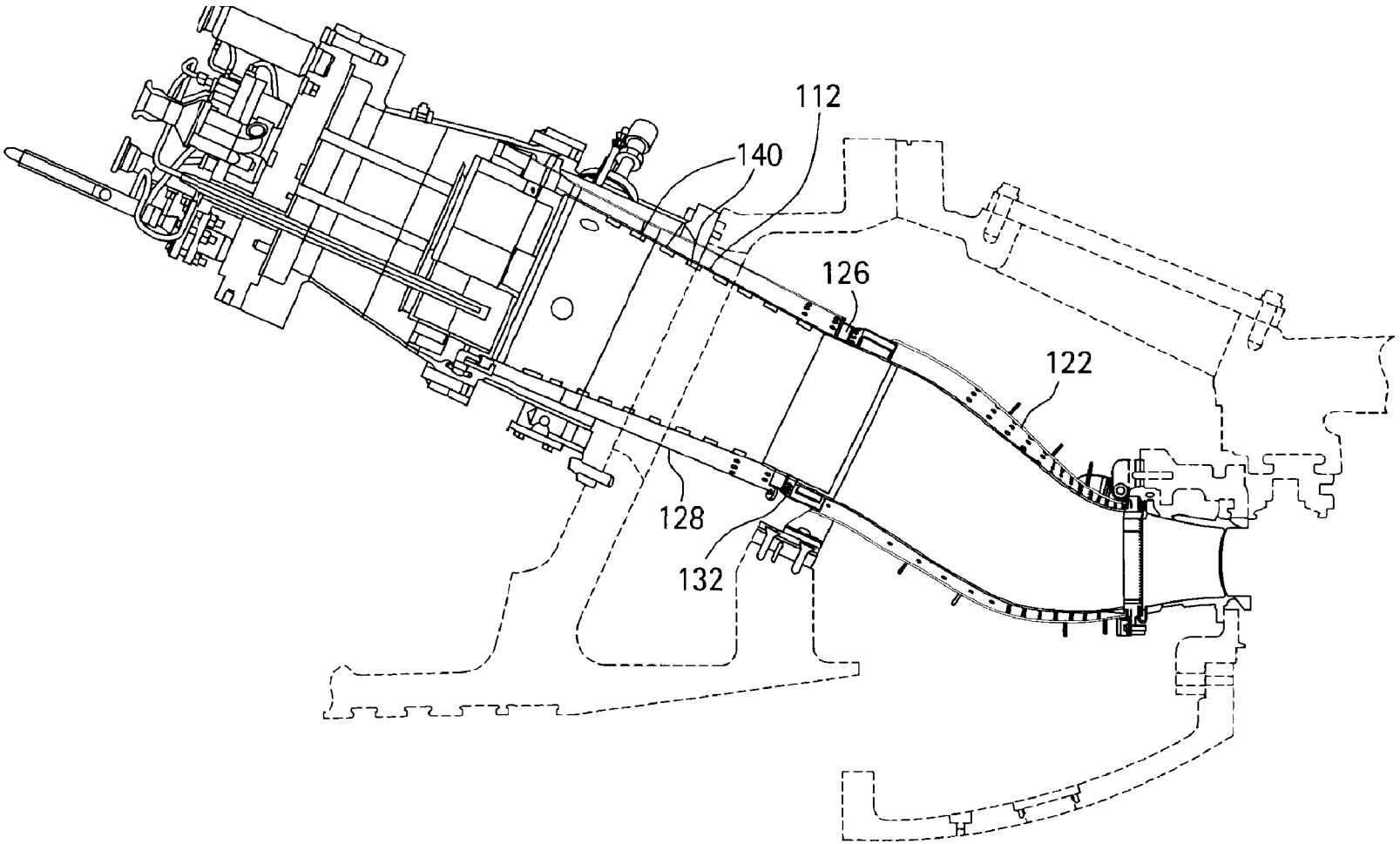
FIG. 6 is a side cross section view of a combustor having a flow sleeve and impingement sleeve surrounding a combustor liner and transition piece in accordance with an exemplary embodiment.
Figure 7:
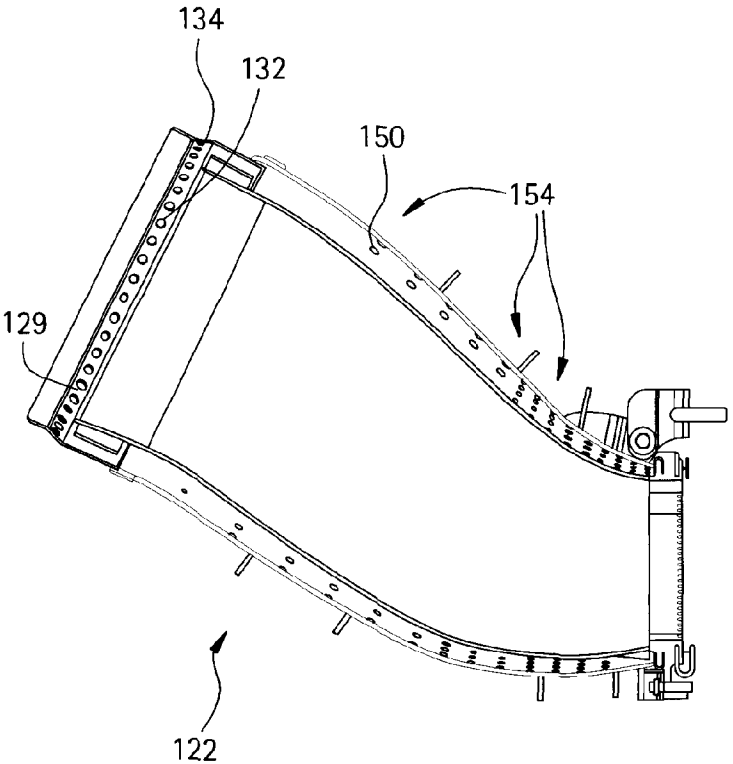
FIG. 7 is an enlarged view of the transition piece impingement sleeve of FIG. 6.

Referring now to FIGS. 6 and 7, an exemplary embodiment of an impingement sleeve 122 is illustrated. Impingement sleeve 122 includes a first row 129 or row 0 of 48 apertures circumferentially disposed at a forward end generally indicated at 132. However, it will be recognized by one skilled in the pertinent art that any number of apertures 132 is contemplated suitable to the desired end purpose. Each aperture 130 has a diameter of about 0.5 inch. Row 0 or a lone row 129 of apertures 132 uniformly allow fresh air therethrough into impingement sleeve annulus 24 prior to entering flow sleeve annulus 30. Row 0 is located on an angular portion 134 of sleeve 122 directing air flow therethrough at an acute angle relative to a cross airflow path through annuli 24 and 30. Lone row 129 of cooling holes (Row 0 apertures 132) disposed towards the forward end of the impingement sleeve 122 are used to control the levels of impingement from the flow sleeve holes, thus avoiding cold streaks.

More specifically, flow sleeve 128 includes a hole arrangement without disposing thimbles therethrough to minimize flow impingement on liner 112. Such combustor liner cooling thimbles are disclosed in U.S. Pat. No. 6,484,505, assigned to the assignee of the present application and is incorporated herein in its entirety. Furthermore, liner 112 is fully turbulated, thus reducing back side cooling heat transfer streaks on liner 112. Fully turbulated liner 112 includes a plurality of discrete raised circular ribs or rings 140 on a cold side of combustor liner 112, such as those described in U.S. Pat. No. 6,681,578, assigned to the assignee of the present application and is incorporated herein in its entirety.

In accordance with an exemplary embodiment, combustor liner 112 is formed with a plurality of circular ring turbulators 140. Each ring turbulator 140 comprises a discrete or individual circular ring defined by a raised peripheral rib that creates an enclosed area within the ring. The ring turbulators are preferably arranged in an orderly staggered array axially along the length of the liner 112 with the rings located on the cold side or backside surface of the liner, facing radially outwardly toward a surrounding flow sleeve 128. The ring turbulators may also be arranged randomly (or patterned in a non-uniform but geometric manner) but generally uniformly across the surface of the liner.

While circular ring turbulators 140 are mentioned, it will be appreciated that the turbulators may be oval or other suitable shapes, recognizing that the dimensions and shape must establish an inner dimple or bowl that is sufficient to form vortices for fluid mixing. The turbulators may also be linear turbulators or inverted turbulators. The combined enhancement aspects of full turbulation and vortex mixing serve along with providing a variable cooling passage height within liner 112 to optimize the cooling at aft end 128 of the liner to improve heat transfer and thermal uniformity, and result in lower pressure loss than without such enhancement aspects.

It will also be noted that row 0 cooling holes 132 provide a cooling interface between slot 126 in sleeve 128 and a first row 150 of fourteen rows 154 (1-14) in sleeve 122. Row 0 minimizes heat streaks from occurring in this region. The precise number of rows 154 may vary according to the needs of the particular application.

Inclusion of row 0 of cooling holes 132 further enhances a cooling air split between flow sleeve 128 and impingement sleeve 122. It has been found that an air split other than 50-50 between the two sleeves 128, 122, e.g., less than 50% of combustor air to flow sleeve 128, is desired to optimize cooling, to reduce streaking, and to reduce the requirement for cooling air to flow through the liner.

Air distribution between the cooling systems for the liner 112 (flow sleeve 128) and transition piece 10 (impingement sleeve 122) is controlled by the effective area distribution of air through the flow sleeve 128 and impingement sleeve 122. In an exemplary embodiment, a target cooling air split from combustor air includes flow sleeve 128 receiving about 32.7% of the combustor air and impingement sleeve 122 receiving about 67.3% of the combustor air based on CFD prediction.

Transition pieces 10 and their associated impingement sleeves are packed together very tightly in the compressor discharge casing. As a result, there is little area through which the compressor discharge air can flow in order to cool the outboard part of the transition duct. Consequently, the air moves very rapidly through the narrow gaps between adjacent transition duct side panels, and the static pressure of the air is thus relatively low. Since impingement cooling relies on static pressure differential, the side panels of the transition ducts are therefore severely under cooled. As a result, the low cycle fatigue life of the ducts may be below that specified. An example of cooling transition pieces or ducts by impingement cooling may be found in commonly owned U.S. Pat. No. 4,719,748.

Figure 8:
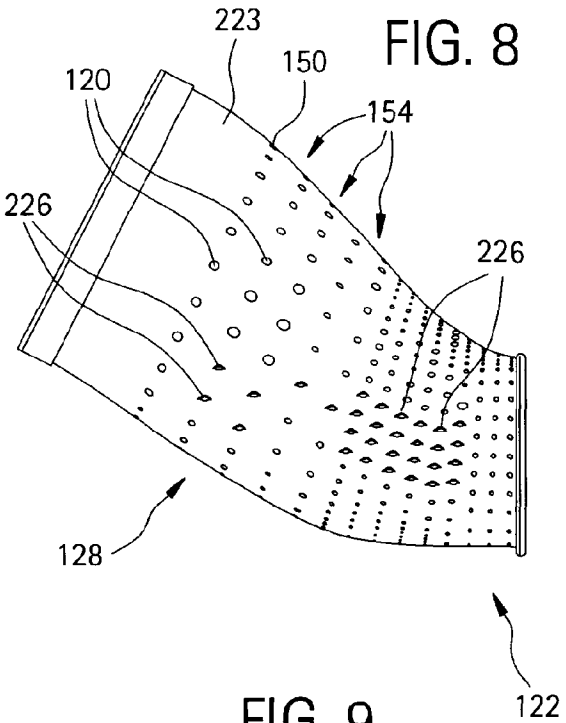
FIG. 8 is a simplified side elevation of an impingement sleeve, illustrating aerodynamic scoops in accordance with an exemplary embodiment.
Figure 9:
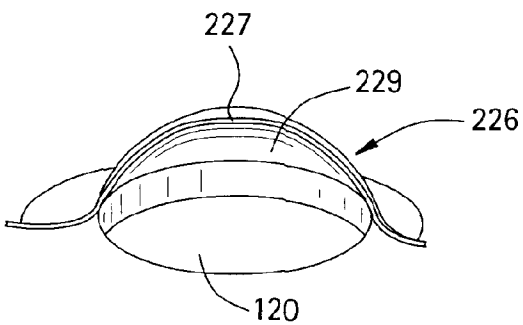
FIG. 9 is an enlarged detail of an aerodynamic scoop on the impingement sleeve.

FIG. 8 shows a transition piece impingement sleeve 122 with aerodynamic "flow catcher devices" 226 applied in accordance with an exemplary embodiment. In this exemplary embodiment, the devices 226 are in the form of scoops that are mounted on the surface 223 of the sleeve, along several rows of the impingement sleeve cooling holes 120, extending axially, circumferentially or both, preferably along the side panels that are adjacent similar side panels of the transition duct. As noted above, it is the side panels of the transition piece 10 that are most difficult to cool, given the compact, annular array of combustors and transition pieces in certain gas turbine designs. A typical scoop can either fully or partially surround the cooling hole 120, (for example, the scoop could be in the shape of a half cylinder with or without a top) or partially or fully cover the hole and be generally part-spherical in shape. Other shapes that provide a similar flow catching functionality may also be used. As best seen in FIGS. 8 and 9, each scoop has an edge 227 that defines an open side 229, the edge lying in a plane substantially normal to the surface 223 of the impingement sleeve 122.

Scoops 226 are preferably welded individually to the sleeve, so as to direct the compressor discharge air radially inboard, through the open sides 229, holes 120 and onto the side panels of the transition duct. Within the framework of the invention, the open sides 229 of the scoops 226 can be angled toward the direction of flow. The scoops can be manufactured either singly, in a strip, or as a sheet with all scoops being fixed in a single operation. The number and location of the scoops 226 are defined by the shape of the impingement sleeve, flow within the compressor discharge casing, and thermal loading on the transition piece by the combustor.

In use, air is channeled toward the transition piece surface by the aerodynamic scoops 226 that project out into the high speed air flow passing the impingement sleeve. The scoops 226, by a combination of stagnation and redirection, catch air that would previously have passed the impingement cooling holes 120 due to the lack of static pressure differential to drive the flow through them, and direct the flow inward onto the hot surfaces (i.e., the side panels) of the transition duct, thus reducing the metal temperature to acceptable levels and enhancing the cooling capability of the impingement sleeve.

One of the advantages of this invention is that it can be applied to existing designs, is relatively inexpensive and easy to fit, and provides a local solution that can be applied to any area on the side panel needing additional cooling.

A series of CFD studies were performed using a design model of a fully turbulated liner 112 and flow sleeve 128 having optimized flow sleeve holes with boundary conditions assumed to be those of a 9FB 12kCI combustion system of the assignee of the present application under base load conditions. Results of the studies indicate that, under normal operating conditions, the design of liner 112 and flow sleeve 128 provide sufficient cooling to the backside of the combustion liner. Predicted metal temperatures along a length of flow sleeve 128 indicate significant reduction in metal temperature variations with reference to FIG. 11.

FIGS. 10 and 11 represent the metal temperatures within prior art liner 100 and liner 112 of the present invention, respectively. As shown in FIG. 11, liner 112 exhibits more uniform metal temperatures than the streaking exhibited with prior art liner 100 in FIG. 10. As noted above, it has been found that by merely altering or balancing the circumferential effective area and its pattern of distribution with respect to the flow and impingement sleeves to optimize uniform air flow to eliminate unwanted streaking in previous designs, thus producing acceptable thermal strains at these increased metal temperatures. Again, this not only helps promote the service life of the liner but also allows a portion of the airflow that previously had to be directed through the liner to now be routed to combustion section 12 of the turbine to improve combustion and reduce emissions.

Optimizing the cooling along a length of the liner has significant advantages over current liner constructions. A particular advantage is that because of the improvement in cooling with the new liner, less air is required to flow through the liner to achieve desired liner metal temperatures (less air may be required, but in the embodiments disclosed, the liner is actually still using the same total amount of air over the last portion of the liner and less air is being forced through the impingement apertures of the liner); and, there is a balancing of the local velocity of air in the liner passage with the local temperature of the air. This provides a constant cooling heat flux along the length of the liner. As a result, there are reduced thermal gradients and thermal stresses within the liner. The reduced cooling air requirements also help prolong the service life of the liner due to reduced combustion reaction temperatures. Finally, the reduced airflow requirements allow more air to be directed to the combustion section of the turbine to improve combustion and reduce turbine emissions.

EXPERIMENTAL APPARATUS AND METHOD

Figure 12:
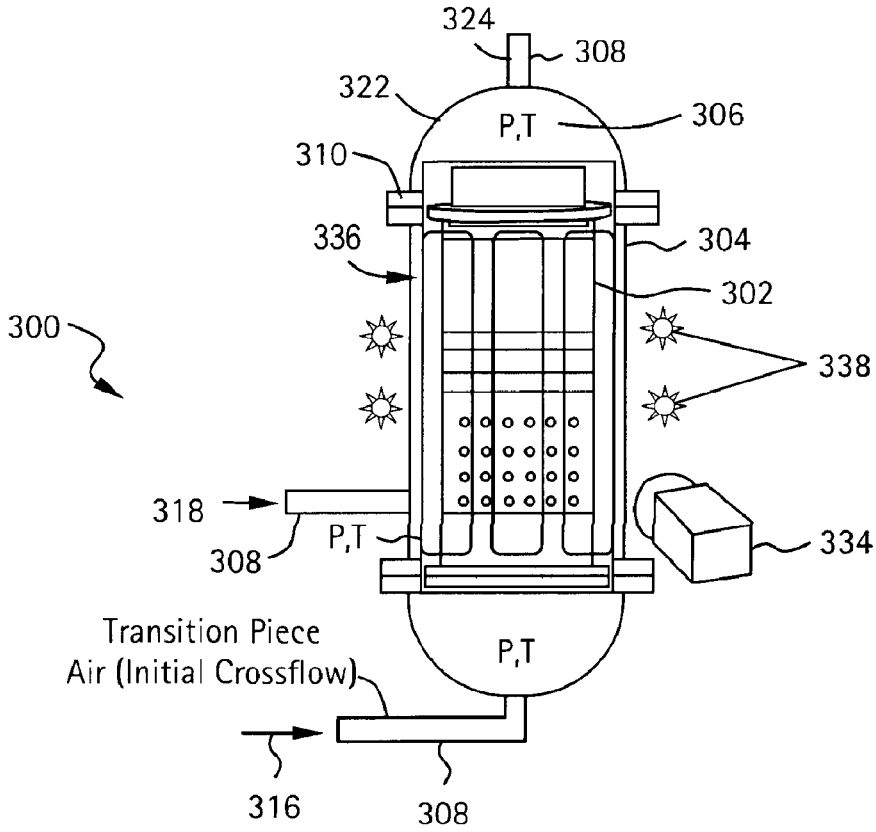
FIG. 12 is a schematic view of a test section and module used to study and evaluate heat transfer coefficients and pressure drop in a large gas turbine reverse flow combustion system in accordance with an exemplary embodiment.

With respect to the above disclosure, a test section model 300 illustrated in FIG. 12 was used to study and evaluate heat transfer coefficients and pressure drop in a large gas turbine reverse flow combustion system. This system is very similar to the low NOx design depicted in FIG. 1. The combustion system model is composed of a test section or inner liner 302 to contain hot combustion gases and an outer vessel or flow sleeve 304 to contain and control cooling flow. The experimental facility used in this study is a cold flow parallel plate test section 302 as shown in FIG. 12. The geometry of the test section model 300 is modeled and scaled to match the annulus geometry of the combustion liner and flow sleeve assembly of FIG. 1, for example. The test section model 300 is equivalent to a quarter-sector of the combustor system. Annulus spacing defined between liner 302 and sleeve 304 is matched at each streamwise location. In an exemplary embodiment, test section 300 is contained in a three-piece ASME pressure vessel 306 that is 61 cm in diameter and 220 cm long when assembled. Each section of the vessel 306 contains a pipe nozzle 308 for air feed or air exhaust. The test section 302 bolts to flanges 310 inside the pressure vessel 308 (FIG. 2), which provide sealing between the three sections creating separate plenums.

Figure 13:
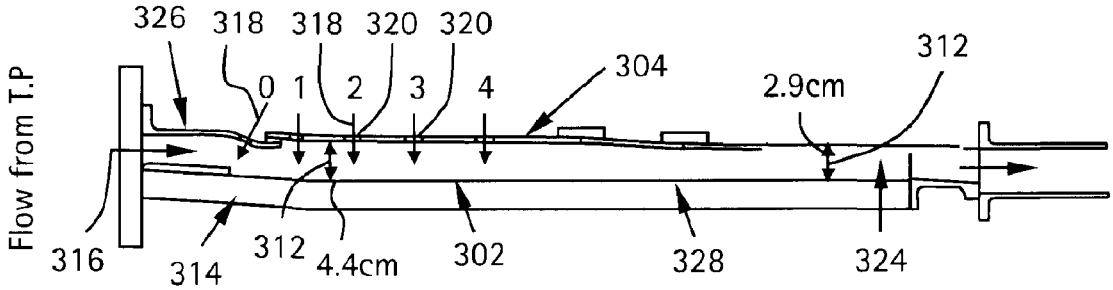
FIG. 13 is a partial cross section view of a flow sleeve and liner forming a varying passage height therebetween in accordance with an exemplary embodiment.

One separate embodiment of a flow passage test section model that was used for evaluation is depicted partially with a cross section view in FIG. 13. The embodiment depicted in FIG. 13 includes a test section 300 that is approximately 35.1 cm wide and 113.4 cm long. An average passage height 312 is 3.9 cm, varying from 2.9 to 4.4 cm, as shown in FIG. 13. Walls defining each liner 302 and flow sleeve 304 are fabricated of aluminum. A test surface defining liner 302 is 0.76-mm thick aluminum with 2.54 cm of acrylic backing 314 for insulation and mechanical support.

The test is operated using room temperature cooling air supplied from dedicated compressors (not shown). There are two controlled cooling flows, each measured with a standard ASME square edge orifice station. A first cooling flow 316 is brought in as initial cross flow from one plenum supply. A second cooling flow 318 is brought in through a second plenum feeding five rows of impingement jets 320. Both flows 316, 318 are metered and controlled independently. The combined cooling flows 316, 318 exhaust into a vessel top section 322, where a valve 324 controls the back pressure. FIG. 13 shows the flow circuit of the test section model 300. Passage pressures are monitored generally at 324 with static pressure taps in the flow sleeve 304 at 13 axial positions. The inlet pressure profile is measured generally at 326 with 5 static pressure taps distributed spanwise (circumferentially) before the first row (0) of cooling jets 320. Air temperatures are measured at the orifice stations, each section of the vessel 306, and axially at 5 locations in the test section (equally spaced from inlet to exit). There were also 5 thermocouples spread spanwise at the channel exit to check uniformity. Under all present test conditions, the inlet cross flow is quite uniform in distribution, and all heat transfer tests show excellent spanwise distribution uniformity for each impingement row and the total downstream flow. Nominal model flow conditions for the embodiment of FIG. 13 are listed below:

| | |
|---|---|
| Passage Re (ave.) | $8.4 \times 10^5$ |
| Jet $Re_j$ range | $1.7 \times 10^5$ to $2.8 \times 10^5$ |
| Gj/Gc range | 0.26 to 0.6 |
| Cross Flow | 0.98 kg/sec |
| Impingement Flow | 1.69 kg/sec |
| Impingement Pressure | 558 kPa |
| Air Inlet Temperature | 22° C. |
| Passage Mach Number | 0.02–0.09 |

The impingement jet diameters are not uniform. Each row has a different jet size, hence the range of jet Reynolds numbers and cross flow ratios. Sharp, square turbulators 328 each with full fillet radius are machined in the liner surface over the latter 50% of the flow path corresponding to an aft end. The turbulators 328 are transverse to the flow, each with a height of 0.76 mm, a pitch-to-height ratio of 10, and an average height-to-channel height ratio of 0.022.

It will be noted and recognized that the following nomenclature used throughout is defined as follows:

| | |
|---|---|
| $A_{cf}$ | passage cross flow area |
| $A_j$ | jet area |
| $A_h$ | heater area |

-continued

| | |
|---|---|
| D | jet diameter (mm) |
| h | heat transfer coefficient (W/m2/K) |
| HTC | heat transfer coefficient acronym |
| $G_c$ | crossflow mass velocity = $m_{cf}/A_{cf}$ |
| $G_j$ | jet mass velocity = $m/A_j$ |
| m | jet mass flow rate (kg/s) |
| $m_{cf}$ | passage cross flow rate (kg/s) |
| $Q_{total}$ | total heater power (W) |
| Pr | Prandtl number |
| Re | Channel Reynolds number based on 2 × height |
| $Re_j$ | jet Reynolds number = (4 m)/(D/μ) |
| TP | transition piece acronym |
| $T_{air}$ | plenum supply temperature (° C.) |
| $T_{surface}$ | liner wall temperature |
| μ | viscosity |

Liner wall temperatures are measured utilizing a liquid crystal video thermography method known in the art. A wide band liquid crystal pre-applied to a Mylar sheet was calibrated over its entire color band. The liquid crystal type was Hallcrest 40-45° C. A curve fit of liquid crystal hue verse calibration temperature was then used to calculate liner wall temperatures. The liner heater system was a stack up consisting of 2.54 cm of acrylic insulation 314, liquid crystal sheet, adhesive, foil heater, adhesive, and a 0.76-mm nominal aluminum plate defining liner wall 302. A thin aluminum plate was used to allow for machining of turbulator trip strips on the liner cold side while minimizing thermal resistance. A uniform heat flux boundary condition is created by applying a high-current, low-voltage DC power to the foil heater. Liquid crystal images were taken with an RGB CCD camera 334 (FIG. 12). Windows 336 in the pressure vessel 306 provided viewing of the test section 302 with the camera 334 as well as lighting access via light sources 338. Each data set is comprised of 4-8 images taken at different heat flux settings. Heat losses were measured to be less then 2% of the total power input. The definition of local heat transfer coefficient used in this study is h=Qwall/(Tsurface−Tair inlet) where Qwall is the power input to the heater divided by the heater area. The liner wall surface temperature is calculated using a one dimensional temperature drop from the liquid crystal surface to the flow path surface. The impingement air supply temperature is used for Tair inlet, and is the same as the initial cross flow supply temperature. The heat up of the air over the heated test section length was less than 1.1° C., while the minimum temperature potential between the surface and the air inlet was 11° C. Because the impingement region heat transfer coefficient 'h' is more appropriately based on the supply air temperature, this same basis was used for the entire test region in order to allow full-surface comparisons. Experimental uncertainty in 'h', is between about 8% and about 15%. Higher uncertainty is associated with higher heat transfer coefficients. The flow rate uncertainty is +1%.

RESULTS AMD DISCUSSION

Conventional Liner Cooling. The combustor liner and impingement flow sleeve arrangement of FIG. 13 with the stated nominal conditions is considered a conventional design in this study. This geometry and cooling method is typical of the F-class power turbines in a fleet of turbines of the assignee of the present application. The concept behind the cooling design is based upon the existing literature and test data concerning heat transfer for arrays of air jets, including the effects of initial and developing cross flow. The initial cross flow in this design is the spent cooling air exiting the region between the transition piece and its flow sleeve. The impingement jets of the liner flow sleeve are essentially compressor discharge cooling air. The existing literature teaches that strong initial cross flow mass velocity relative to the impingement jet mass velocity leads to degraded (lower) impingement heat transfer coefficients for the individual jets as well as for the jet arrays. Since impingement heat transfer is deliberately used to provide higher local and regional heat transfer coefficient magnitudes than that obtained from purely convective flow in the passage, the design tendency is to strengthen the impingement jet Reynolds numbers to overcome the cross flow effects. An alternative solution would be to somehow shield the impingement jets from the cross flow interaction by use of mechanical boundaries. The apparent drawback to these techniques is seen in the other main aspect of strong impingement heat transfer, namely the very high local heat transfer coefficient gradients created by each impingement jet. These gradients can lead to high thermal gradients and stresses in the liner material, and lower life or perhaps even cracking.

Figure 14:
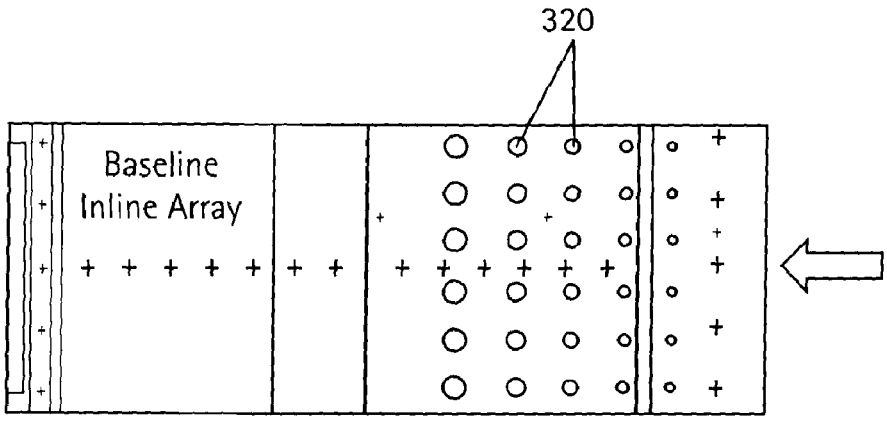
FIG. 14 is a plan view of an impingement geometry of a baseline array for a flow sleeve in accordance with an exemplary embodiment.
Figure 15:
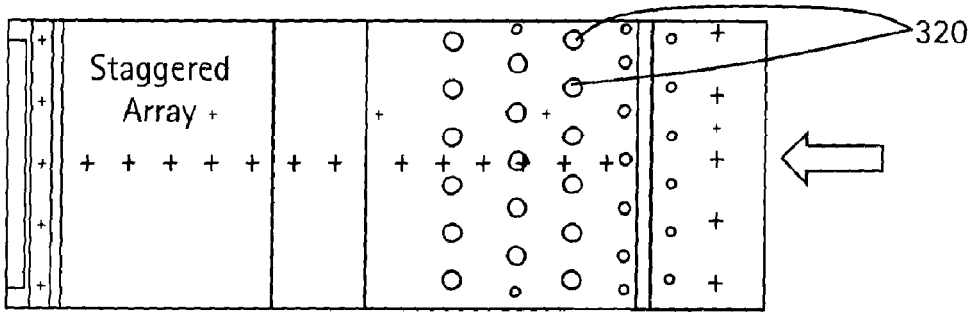
FIG. 15 is a plan view of an impingement geometry of a staggered array for a flow sleeve in accordance with an exemplary embodiment.
Figure 16:
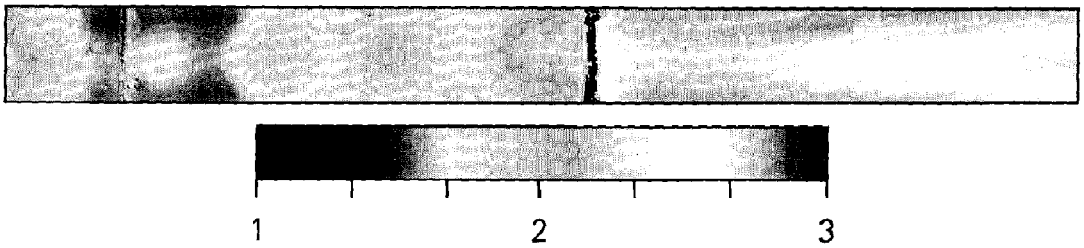
FIG. 16 is a thermograph illustrating heat transfer coefficients along a length of a combustor having the inline impingement array of FIG. 14.

The test method employed for all of the cases of this study results in maps of the local heat transfer coefficients for the liner cooling. FIG. 16 shows the center portion of one such map for the baseline in-line jet array geometry of FIG. 14. Due to the strong impingement jets 320, each jet region is clearly observed. Since one goal of this disclosure is the reduction of HTC gradients, subsequent test cases do not show as much local variation.

Optimized Domain Test Geometries and Conditions

A series of test geometries, twelve in number, were executed around this idea of a more optimized solution domain for overall liner cooling. Jet diameters range from as low as 5.72 mm to as high as 13.34 mm for separate test cases. All tests use the fully turbulated liner surface.

The major parameter which is altered in these tests is the percentage of total flow used as the initial transition piece (TP) cross flow. This initial TP flow is varied from 43.6% to 82.3% of the total flow, so the impingement flow is from 56.4% to 17.7% of the total flow. This represents a new solution domain noted previously as a departure from the conventional design. The test cases are a custom design of experiments using the variables of jet Re number and mass velocity ratios Gc/Gjet.

Optimized Domain Heat Transfer Distributions

Figure 17:
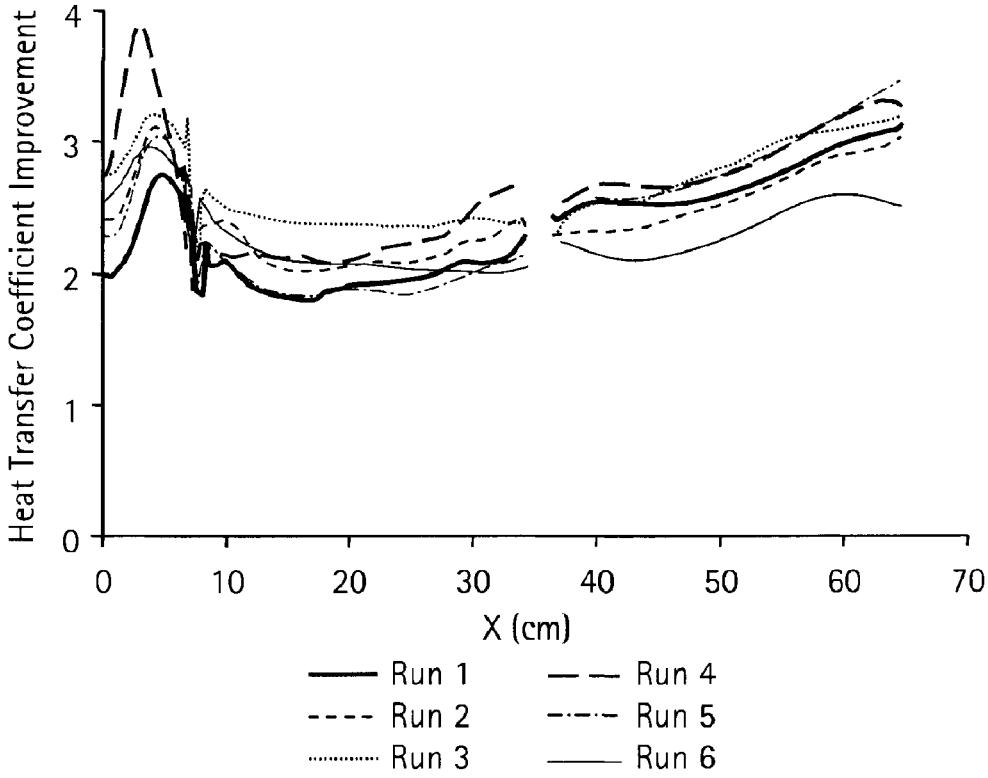
FIG. 17 shows heat transfer coefficients for test Runs 1-6 using the flow sleeve geometry of FIG. 13.

The heat transfer coefficients for test runs 1-6 are shown in FIG. 17. It is apparent that the desired effect of reducing surface gradients in HTC in the impingement region has been achieved. In all six tests, the HTC within the impingement region is close to uniform. Also for all cases, the downstream HTC increases as the passage height 312 declines as in the geometry of FIG. 13, and the level of downstream HTC is elevated.

Figure 18:
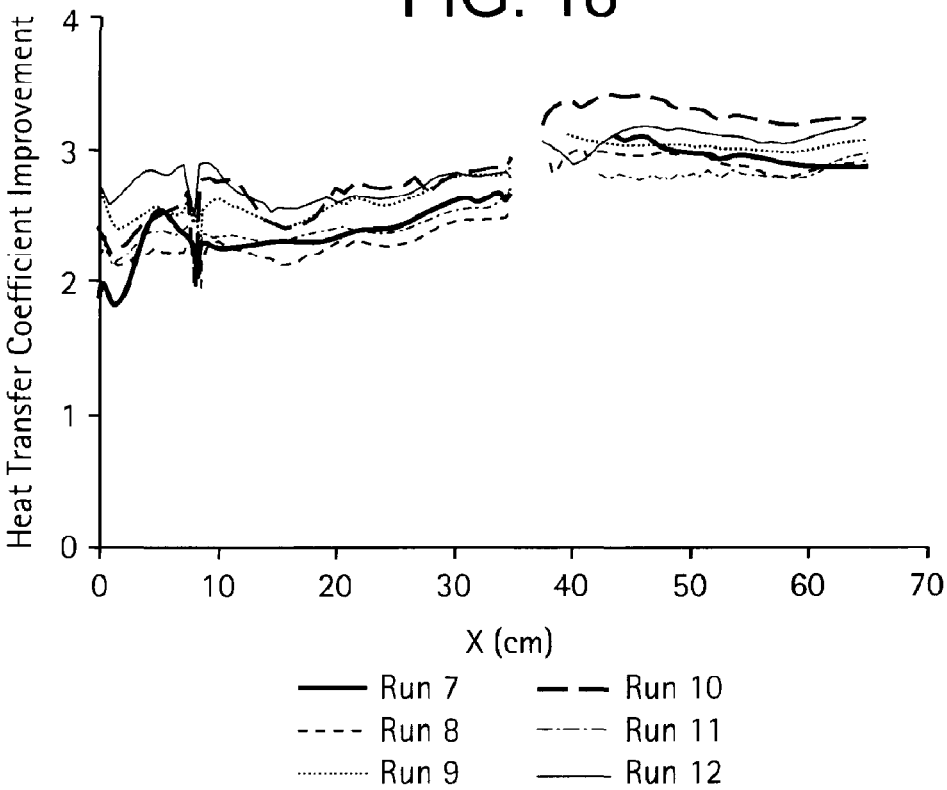
FIG. 18 shows heat transfer coefficients for test Runs 7-12 and using the flow sleeve geometry of FIG. 13 having a reduced passage height.

FIG. 18 shows the HTC results for runs 7-12 using a reduced height flow passage and differing jet parameters. For these tests, the size of the impingement jets 320 is somewhat larger and the impingement region target spacing is reduced. The result is a higher overall heat transfer coefficient, 15% to 20%, both in the impingement region and also in the downstream region. The effect of individual impingement jets 320 on local HTC gradients is seen slightly in these results, but not to a great degree.

Figure 19:
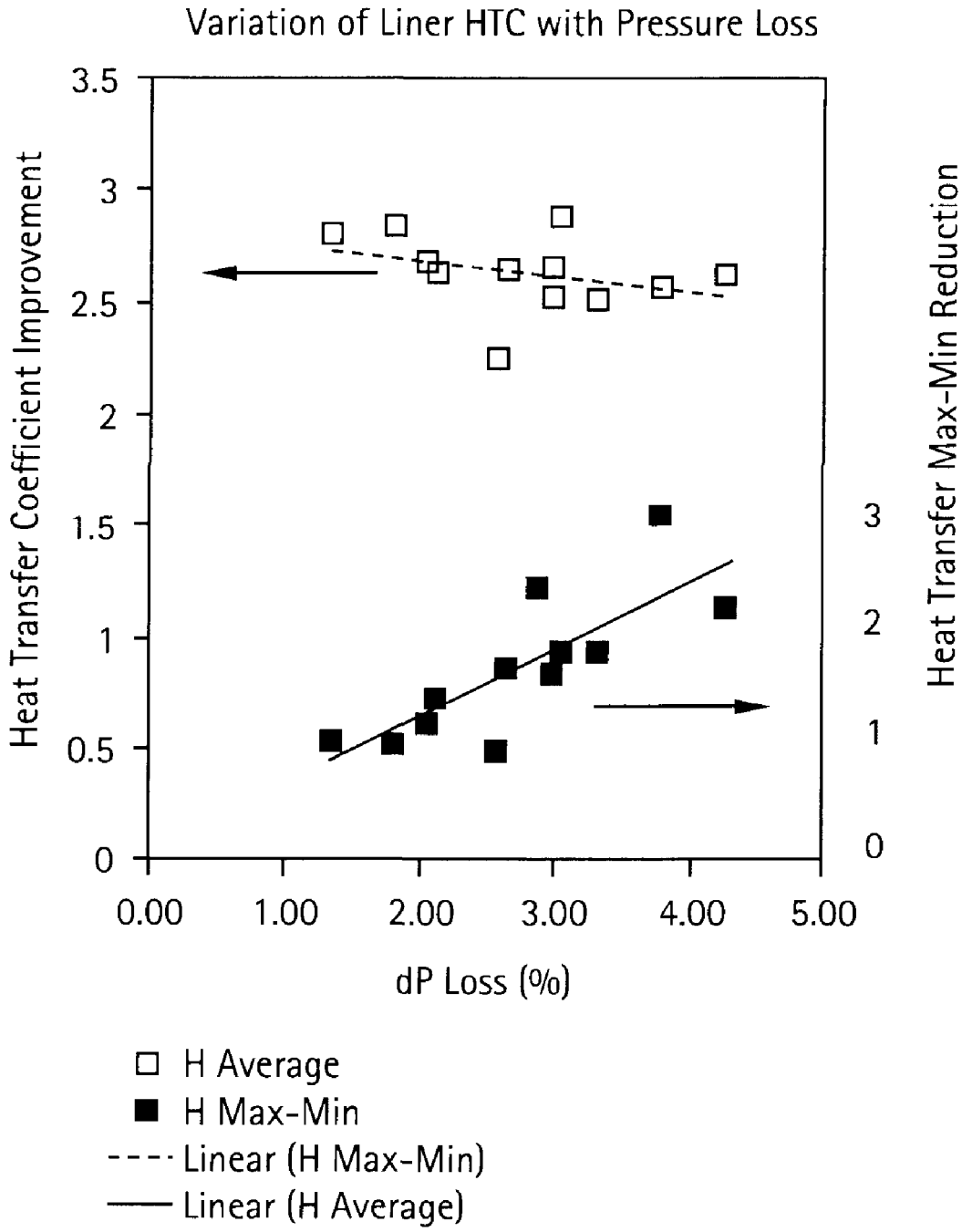
FIG. 19 shows the relationship between maximization of the coolant side HTC, minimization of the HTC surface gradient, and minimization of the pressure loss for all twelve runs in the test series.

As pointed out above, optimization of combustor liner cooling is a matter of several key requirements. Three conditions which can be easily singled out include maximization of the coolant side HTC, minimization of the HTC surface gradient, and minimization of the pressure loss. FIG. 19 shows the relationship between these factors for all twelve runs in the test series depicted in FIGS. 17 and 18. The gradient is provided here as simply the difference between the min and max HTC on the surface. The average HTC is a global average for the entire liner surface. The pressure drop is the percentage of the impingement supply pressure. The overall trend from this data shows that the minimum pressure loss can be obtained with nearly the highest average HTC and close to the lowest HTC gradient, satisfying all conditions.

Figure 20:
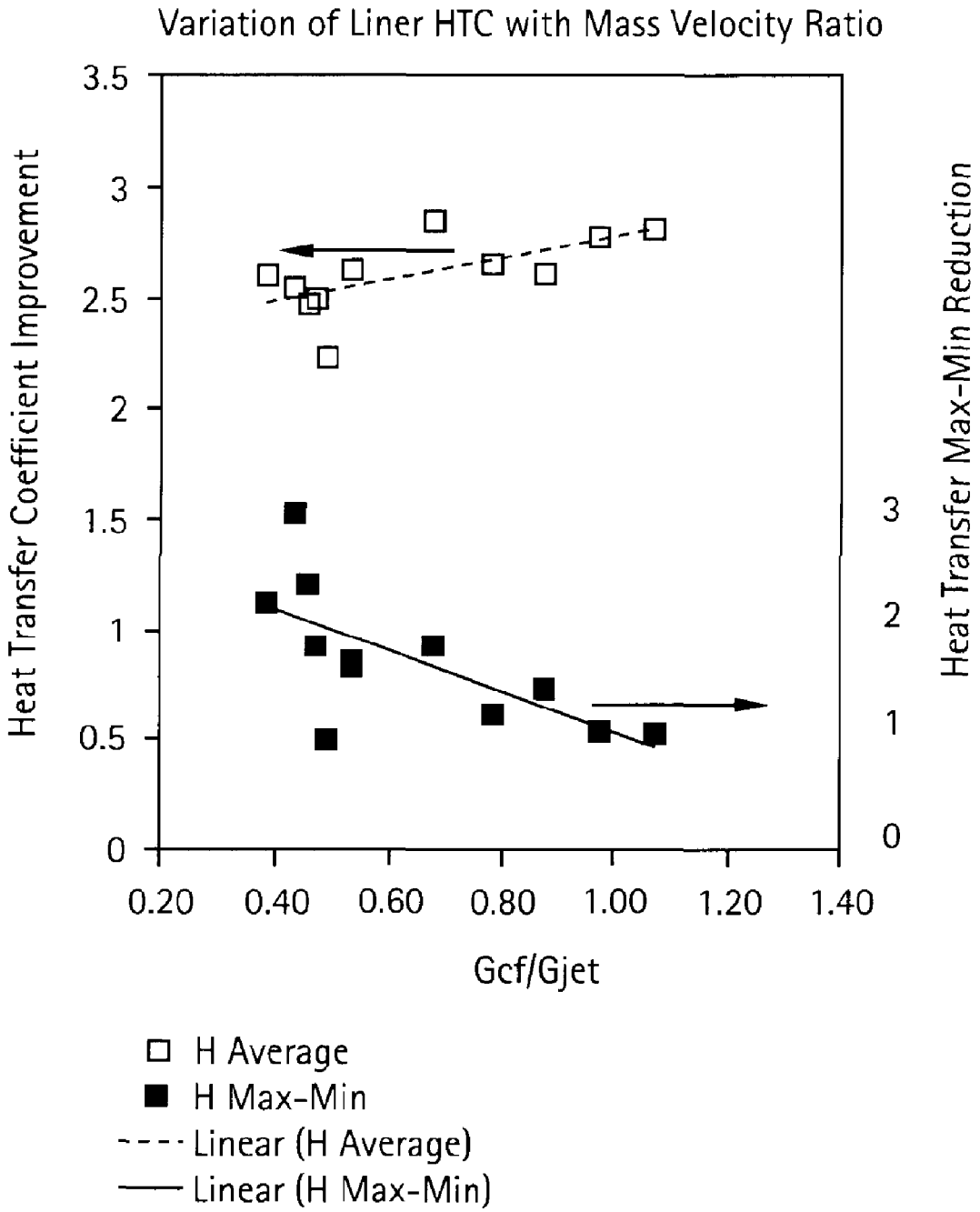
FIG. 20 shows average and gradient HTC values against the mass velocity ratios for all twelve runs in the test series.

FIG. 20 shows these average and gradient HTC values against the mass velocity ratios for all cases. The trend lines in this figure show that higher average HTC and lower HTC gradient result from the higher Gc/Gjet ratios, or higher initial cross flow.

The premise that lower impingement flows of non-penetrating jets into higher initial cross flows may create higher liner heat transfer coefficients and lower gradients has been verified. Of equal importance is that the pressure loss has been reduced from the original 2.1% to only 1.34%.

The above-described investigation performed a parametric investigation of the major factors influencing very high Reynolds number combustor liner cooling. The conventional cooling design is altered away from the traditional strong use of impingement cooling in favor of more convective cooling with flow jets providing bulk turbulence and mixing only. An initial series of tests using fairly weak initial cross flow with much stronger impingement jet flows showed large variations in spatial heat transfer coefficients. These conditions were obtained using roughly 65% of the total cooling flow as impingement and only 35% as initial cross flow from the transition piece cooling. Additional tests with 100% convective flow (no impingement) set the lower bounds on liner heat transfer coefficients and demonstrated that some impingement was required.

A second series of tests based upon far less impingement flow with much higher initial cross flow lead to two major results. First, that lower impingement flows of non-penetrating jets into higher initial cross flows can create higher liner heat transfer coefficients and lower coefficient gradients. Within the tests conducted, the average liner heat transfer coefficients were increased by about 20%, while the difference between minimum and maximum heat transfer coefficient on the surface was cut by half. Second, the present tests demonstrated a pressure loss reduction from the original 2.1% of compressor discharge pressure to only 1.34% by manipulation of impingement flow percentages away from conventional designs. The fact that these results were obtained for the same cooling geometry represents a significant move towards a more optimized combustor liner cooling design domain.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A combustor for a turbine comprising:

a combustor liner including a plurality of turbulators arranged in an array axially along a length defining a length of said combustor liner and located on an outer surface thereof;

a first flow sleeve surrounding said combustor liner with a first flow annulus therebetween,said first flow sleeve having a plurality of rows of cooling holes formed about a circumference of said first flow sleeve for directing cooling air from compressor discharge air into said first flow annulus, and said cooling holes are configured as non penetrating fluid jets providing at least one of bulk flow mixing and turbulence increasing heat transfer from the liner;

a transition piece connected to said combustor liner, said transition piece adapted to carry hot combustion gases to a stage of the turbine;

a second flow sleeve surrounding said transition piece, said second flow sleeve having a second plurality of rows of cooling apertures and a plurality of flow catcher devices disposed on a surface thereof for directing cooling air from compressor discharge air into a second flow annulus between the second flow sleeve and the transition piece, said first flow annulus connecting to said second flow annulus;

wherein said plurality of cooling holes said plurality of cooling apertures are said plurality of flow catcher devices are each configured with an effective area to distribute less then 50%of compressor discharge air to said first flow sleeve and mix with cooling are from said second flow annulus.

2. The combustor of claim 1, wherein said liner is one of a cast alloy liner and a wrought alloy liner.

3. The combustor of claim 1, wherein said plurality of cooling holes said plurality of cooling apertures and said plurality of flow catcher devices are each configured with an effective area to distribute between about 25% to about 40% of compressor discharge air to said first flow sleeve and mix with cooling air from said second flow annulus.

4. The combustor of claim 1, wherein said plurality of rows of cooling holes are substantially uniformly dimensioned.

5. The combustor of claim 1, wherein the non penetrating fluid jets are configured to avoid actual fluid impingement on the liner.

6. The combustor of claim 1, wherein said plurality of rows of cooling holes are configured providing mass velocity ratios (Gc/Gjet) near unity.

7. The combustor of claim 1, wherein said cooling holes are disposed about a circumference of said first flow sleeve in an in-line manner.

8. The combustor of claim 1, wherein said plurality of rows of cooling holes are dimensioned providing mass velocity ratios (Gc/Gjet) near unity.

9. A turbine engine comprising:

a combustion section;

a compressor air discharge section upstream of the combustion section;

a transition region between the combustion and air discharge section;

a turbulated combustor liner defining a portion of the combustion section and transition region, said turbulated combustor liner including a plurality of turbulators arranged in an array axially along a length defining a length of said combustor liner and located on an outer surface thereof;

a first flow sleeve surrounding said combustor liner with a first flow annulus therebetween, said first flow sleeve having a plurality of rows of cooling holes formed about a circumference of said first flow sleeve for directing cooling air from compressor discharge air into said first flow annulus, and said cooling holes are configured as non penetrating fluid jets providing at least one of bulk flow mixing and turbulence increasing heat transfer from the liner;

a transition piece connected to at least one of said combustor liner and said first flow sleeve, said transition piece adapted to carry hot combustion gases to a stage of the turbine corresponding to the air discharge section;

a second flow sleeve surrounding said transition piece, said second flow sleeve having a plurality of rows of cooling apertures and a plurality of flow catcher devices disposed on a surface thereof for directing said cooling air into a second flow annulus between the second flow sleeve and the transition piece, said first flow annulus connecting to said second flow annulus;

wherein said plurality of cooling holes, and said plurality of cooling apertures and said plurality of flow catcher devices are each configured with an effective area to distribute less than 50% of compressor discharge air to said first flow sleeve and mix with cooling air from said second flow annulus.

10. The engine of claim 9, wherein said first plurality of cooling holes, and second plurality of cooling apertures and said plurality of flow catcher devices are each configured with an effective area to distribute between about 25% to about 40% of compressor discharge air to said first flow sleeve and mix with cooling air from said second flow annulus.

11. The engine of claim 9, wherein said plurality of rows of cooling holes are substantially uniformly dimensioned.

12. The engine of claim 9, wherein the non penetrating fluid jets are configured to avoid actual fluid impingement on the liner.

13. The engine of claim 9, wherein said plurality of rows of cooling holes are configured providing mass velocity ratios (Gc/Gjet) near unity.

14. The engine of claim 9, wherein said cooling holes are disposed about the circumference of said first flow sleeve in an in-line manner.

15. The engine of claim 9, wherein said plurality of rows of cooling holes are dimensioned providing mass velocity ratios (Gc/Gjet) near unity.

16. A method of cooling a combustor liner of a gas turbine combustor, said combustor liner having a substantially circular cross-section, and a first flow sleeve surrounding said liner in substantially concentric relationship therewith creating a first flow annulus therebetween for feeding air to the gas turbine combustor, and wherein a transition piece is connected to said combustor liner, with the transition piece surrounded by a second flow sleeve, thereby creating a second flow annulus in communication with said first flow annulus; the method comprising:

providing a plurality of axially spaced rows of cooling holes in said flow sleeves, each row extending circumferentially around said flow sleeves, a first of said rows in said second sleeve is located proximate an end where said first flow sleeve and said second flow sleeve interface;

providing a plurality of axially spaced rows of flow catcher devices in said second flow sleeve, each row extending circumferentially around at least a portion of said second flow sleeve;

supplying cooling air from compressor discharge to said cooling holes;

configuring said cooling holes as non penetrating fluid jets providing at least one of bulk flow mixing and turbulence increasing heat transfer from the liner, and configuring said flow catcher devices to aerodynamically cooperate with said cooling holes in said second flow sleeve, the cooling holes having and effective area and the flow catcher devices having an effective aerodynamic profile to distribute less than one half of compressor discharge air to said first flow sleeve and mix with the cooling air flowing from said second flow annulus.

17. The method combustor of claim 16, further comprising:

configuring said cooling holes with an effective area and said flow catcher devices with an effective aerodynamic profile to distribute between about 25% to about 40% of compressor discharge air to said first flow sleeve and mix with cooling air from said second flow annulus.

18. The method of claim 16, further comprising disposing said cooling holes about a circumference of said first flow sleeve in an in-line manner, wherein said cooling holes are substantially uniformly dimensioned.

19. The method of claim 16, wherein the non penetrating fluid jets are configured to avoid actual fluid impingement on the liner.

20. The method of claim 16, wherein said cooling holes are at least one of configured and dimensioned providing mass velocity ratios (Gc/Gjet) near unity.

* * * * *